US008950973B2

(12) United States Patent
Wilbanks et al.

(10) Patent No.: US 8,950,973 B2
(45) Date of Patent: Feb. 10, 2015

(54) WATERCRAFT VEHICLE LIFT AND METHOD OF USING

(71) Applicants: Chad Wilbanks, Austin, TX (US); Christopher J. Corley, Austin, TX (US)

(72) Inventors: Chad Wilbanks, Austin, TX (US); Christopher J. Corley, Austin, TX (US)

(73) Assignee: Lone Star Docks, Austin, TX (US)

( * ) Notice: Subject to any disclaimer, the term of this patent is extended or adjusted under 35 U.S.C. 154(b) by 63 days.

(21) Appl. No.: 13/726,606

(22) Filed: Dec. 25, 2012

(65) Prior Publication Data

US 2014/0178129 A1 Jun. 26, 2014

(51) Int. Cl.
*B63C 3/06* (2006.01)
*B63C 3/00* (2006.01)

(52) U.S. Cl.
CPC ..... *B63C 3/00* (2013.01)
USPC ..... 405/3; 114/44; 414/678

(58) Field of Classification Search
CPC ..... B63B 35/40; E02C 5/00
USPC ..... 405/1, 3; 114/258, 259, 263, 44, 48; 414/678; 254/122–126, 93 L
See application file for complete search history.

(56) References Cited

U.S. PATENT DOCUMENTS

| | | | | |
|---|---|---|---|---|
| 4,148,528 | A | 4/1979 | Channell | |
| 4,321,004 | A * | 3/1982 | Mills | 414/490 |
| 4,895,479 | A | 1/1990 | Michaelsen | |
| 4,901,980 | A | 2/1990 | Hansen | |
| 5,184,914 | A | 2/1993 | Basta | |
| 5,485,798 | A | 1/1996 | Samoian | |
| 5,755,529 | A * | 5/1998 | Follett | 405/3 |
| 5,919,000 | A | 7/1999 | Unkle | |
| 6,602,022 | B1 | 8/2003 | Wilkins | |
| 6,612,775 | B1 | 9/2003 | Hewitt | |
| 7,021,861 | B2 | 4/2006 | Basta | |
| 7,246,970 | B2 | 7/2007 | Hey | |
| 7,273,329 | B2 | 9/2007 | Spratt | |
| 8,221,028 | B2 | 7/2012 | Smith | |
| 2005/0166821 | A1 | 8/2005 | McKenzie | |
| 2010/0189502 | A1 | 7/2010 | Basta | |
| 2013/0279982 | A1 * | 10/2013 | Wilberts et al. | 405/3 |

* cited by examiner

*Primary Examiner* — Sean Andrish
(74) *Attorney, Agent, or Firm* — Pierson IP, PLLC

(57) ABSTRACT

Embodiments described herein disclose a watercraft vehicle lift. The watercraft vehicle lift may comprise a pivoting hinge configured to rotate around a fixed axis, a lift configured to extend and contract an arm to apply force and a scissor hinge with a plurality of pivoting points configured to extend and contract and receive force from the arm of the lift at an upward angle.

16 Claims, 5 Drawing Sheets

WATERCRAFT VEHICLE LIFT AND METHOD OF USING

TECHNICAL FIELD

This disclosure relates generally to systems and methods for a watercraft vehicle lift. Specifically, this disclosure relates to a watercraft vehicle lift configured to allow a watercraft to drive onto the lift in shallow water.

BACKGROUND

It is desirable for a watercraft to be able to be loaded onto a lift and elevated above a water level of a body of water to protect the watercraft from various elements.

Conventionally, hydraulic watercraft lifts are designed with a frame that is in the shape of a parallelogram with a stationary base and a lift platform coupled to parallel sides. Other conventional watercraft lifts include free floating, self-contained lifts that are configured to raise and lower corresponding to a water level of a body of water.

In conventional watercraft lifts, a lift platform that supports a watercraft is lowered, the watercraft is positioned above the lift platform, and a hydraulic lift extends to raise the lift platform to receive the watercraft. When the hydraulic lift is extended, the lift platform is raised above the water level to support the watercraft above the water level.

Conventional lifts, however, require that the entirety of a hydraulic watercraft lift system be positioned below the watercraft before the watercraft is raised and/or lowered. Therefore, if a watercraft is operating in shallow water it may be impossible to position the entirety of the watercraft lift system below the watercraft before the watercraft is raised and/or lowered.

Accordingly, needs exist for improved boat lifting systems and methods that are configured to operate in shallow water.

SUMMARY

Embodiments described herein disclose watercraft lifting systems and methods that are configured to allow a watercraft vehicle to be driven onto a lifting system in shallow water without damaging, harming, and/or impairing any portion of the watercraft, such as elements disposed underneath the watercraft including fins, propellers, etc. A portion of the watercraft lifting system may then be raised so bunk beams are parallel to a water level. Therefore, the entirety of the lifting system is not required to be positioned below the watercraft vehicle before lifting the vehicle.

The watercraft lifting system may include parallel bunk beams that are configured to interface with and support a watercraft vehicle.

In one embodiment, at a first end of a lifting system, the parallel bunk beams may be coupled to a fixed, pivoting hinge that may be positioned at a height that is approximately at a water level of a body of water. In one embodiment, the bunk beams may be configured to extend past a base of the lifting system.

At a second end of the lifting system, the bunk beams may be coupled to a scissor hinge at a first pivot, where the bunk beams may be configured to extend past the first pivot.

The scissor hinge may be configured to couple with the bunk beams at the first pivot, a base of the watercraft lifting system at a second pivot, and a hydraulic lift at a third pivot.

In one embodiment, if an arm of the hydraulic lift is extended, the scissor hinge may extend so that the bunk beams are substantially parallel to the water level. In one embodiment, if the arm of the hydraulic lift is extended, the first, second, and third pivots may be in a substantially vertical plane perpendicular to the base of the watercraft lifting system.

If the arm of the hydraulic lift is contracted, the arm may pull the third pivot to a position closer to the lift than when the arm of the hydraulic lift is extended, and the third pivot point may be close to the floor of the body of water and/or the base of the watercraft lifting system.

Additionally, in one embodiment, if the arm of the hydraulic lift is contracted, the first pivot may move in a downward position and be in a position closer to the second pivot, and the bunk beams may be positioned in a downward angle.

If the bunk beams are positioned in a downward angle, a watercraft vehicle may drive onto the bunk beams. The arm of the hydraulic lift may then be extended and the bunk beams may rise to support the watercraft at a level parallel to the water level.

In one embodiment, the fixed, pivoting hinge may be coupled to the base of the watercraft vehicle lifting system via adjustable legs. The adjustable legs may be configured to change the height of the fixed, pivoting hinge via any known mechanism, such as manually via pins or electronically. By adjusting the legs of the vehicle lifting system, the position of the fixed, pivoting hinge may be adjusted to correspond to various water levels and/or any desired height.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore nonlimiting, embodiments illustrated in the drawings, wherein identical reference numerals designate the same components. Note that the features illustrated in the drawings are not necessarily drawn to scale.

DETAILED DESCRIPTION

Figure 1:
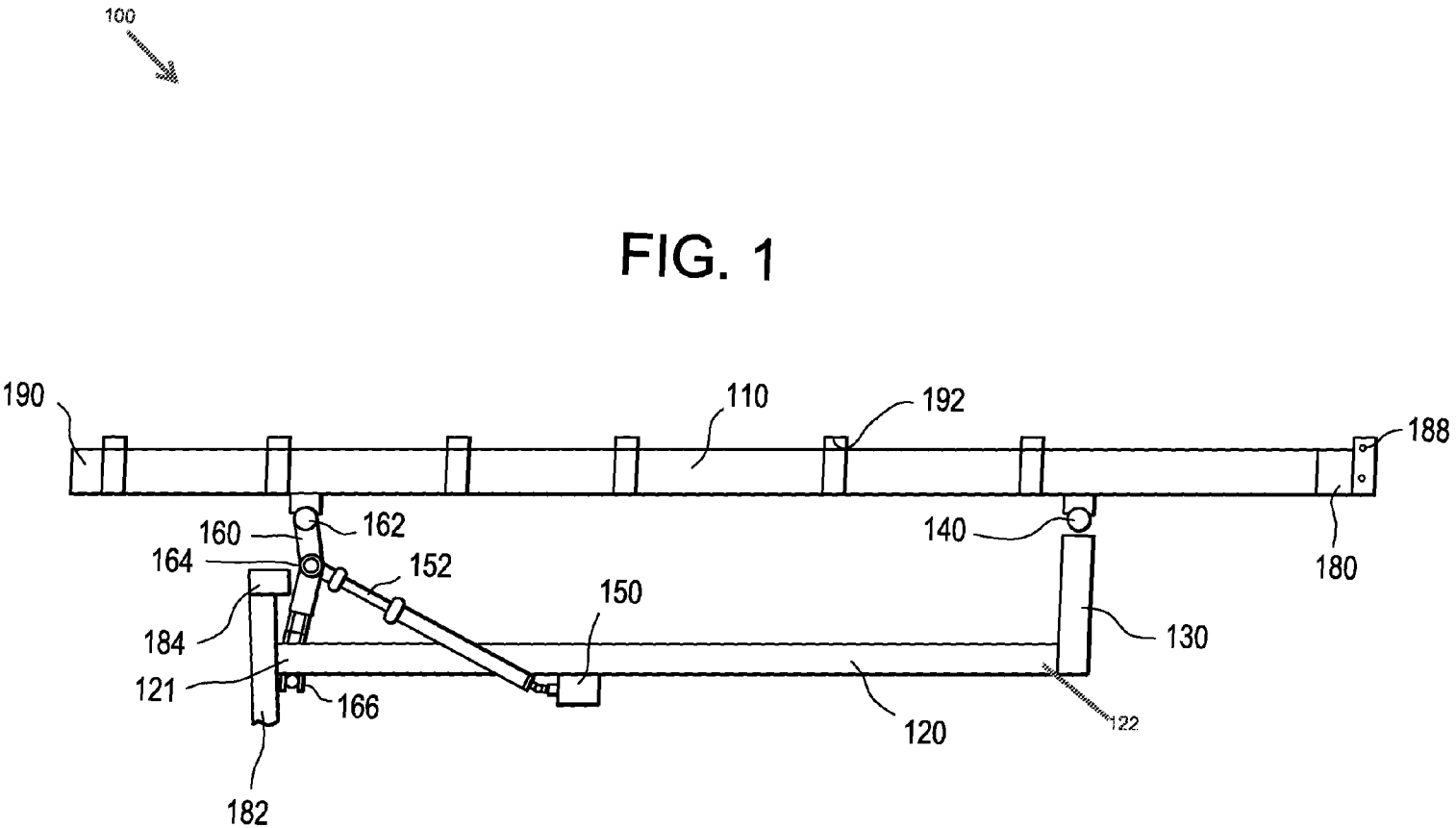
FIG. 1 depicts one embodiment of a watercraft vehicle lift.

The invention and the various features and advantageous details thereof are explained more fully with reference to the nonlimiting embodiments that are illustrated in the accompanying drawings and detailed in the following description.

Descriptions of well-known starting materials, processing techniques, components and equipment are omitted so as not to unnecessarily obscure the invention in detail.

It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations includes, but is not limited to: "for example," "for instance," "e.g.," "in one embodiment."

Before discussing specific embodiments, a general discussion of the vehicle lifting system may prove helpful.

Embodiments disclosed herein are directed towards a watercraft vehicle lifting system that is configured to allow a watercraft vehicle to drive onto bunk beams of the lifting system in shallow water. The term shallow water disclosed herein refers to bodies of water with less than 3' of water. The term watercraft vehicle may refer to or describe any type of vehicle configured to operate in bodies of water including ships, boats, hovercrafts, jet ski, etc. configured to propelled by any known means.

The watercraft vehicle lifting system may include parallel bunk beams that are coupled to a fixed, pivoting hinge on a first end and a scissor hinge on a second end.

While the scissor hinge is in a collapsed position, the bunk beams may be positioned at a downward angle and a watercraft vehicle may be driven onto the bunk beams and interface with the watercraft vehicle. An arm of a lift coupled to the scissor hinge may then be lengthened to extend the scissor hinge. By extending the scissor hinge, the bunk beams may be raised to support the watercraft vehicle at a level parallel to the water level.

Turning now to FIG. 1, an embodiment of a watercraft vehicle lift 100 is depicted.

Watercraft vehicle lift 100 may include parallel bunk beams 110, base 120, lift 150, and scissor hinge 160.

Bunk beams 110 may be comprised of high density polyethylene or any other polymer comprising long hydrocarbon chains configured to allow a watercraft vehicle to be driven onto the bunk beams 110 without damaging a surface of the watercraft vehicle while still supporting the hull of the watercraft vehicle. If the bunk beams 110 are positioned at a downward angle, a watercraft vehicle may be driven onto the bunk beams.

In one embodiment, bunk beams 110 may include couplers 192 and bow stop 188. Couplers 192 may be disposed on an inner surface of base 120. Couplers 192 may be configured to cushion the support of the watercraft vehicle while the watercraft vehicle is being driven onto bunk beams 110 and/or when bunk beams 110 are supporting the watercraft vehicle. In embodiments, couplers 192 may be positioned at even or uneven intervals along bunk beams 110.

In one embodiment, on a first end 180 of bunk beams 110 may include bow stop 188. Bow stop may be configured to safely stop a forward movement of the watercraft vehicle while the watercraft vehicle is driven up onto bunk beams 110.

Base 120 may be configured to support the watercraft vehicle lift 100. Base 120 may be positioned adjacent to and extend across at least a portion of a floor of a body of water, and may form a frame in a rectangular shape. Base 120 may be comprised of metal such as galvanized steel, iron, aluminum or any other material that will not corrode, rust, deteriorate, etc. when disposed in a body of water. In one embodiment, a first end 180 and a second end 190 of bunk beams 110 may be configured to extend past corresponding sides of base 120. Therefore, in one embodiment, bunk beams 110 may be longer than base 120.

In one embodiment, legs 130 may be disposed at an end 122 of base 122. Legs 130 may be coupled to base 120 and be substantially perpendicular to base 120. On an upper surface of legs 130 may be a fixed, pivoting hinge 140. Fixed, pivoting hinge 140 may be configured to be positioned at a height that is approximately at a water level of a body of water and be coupled to legs 130 and bunk beams 110. In one embodiment, fixed, pivoting hinge 140 may be positioned adjacent to legs 130, on an upper surface of legs 130, below an upper surface of legs 130, in a plane level even with an upper surface of legs 130, below bunk beams 110, and/or at a level even with bunk beams 110. In one embodiment, legs 130 may be adjustable legs. Legs 130 may be configured to change the height of the fixed, pivoting hinge via any known mechanism, such as manually via pins or electronically. By adjusting the height of legs 130, the position of the fixed, pivoting hinge 140 may be adjusted to correspond to various water levels. One skilled in the art will appreciate that instead of fixed, pivoting hinge 140 being coupled to legs 130 that are coupled to a base 120 of the vehicle lift 100, that fixed, pivoting hinge may be coupled to another structure such as a dock or boat housing.

Lift 150 may be any type of machinery configured to apply force to scissor hinge 160. In one embodiment, lift 150 may be a hydraulic lift with an arm 152 configured to extend and contract to apply force to scissor hinge 160. One skilled in the art will appreciate lift 150 may be any type of system configured to a mechanical advantage to apply force to raise or lower bunk beams 110.

In one embodiment, lift 150 may be configured to be coupled to base 120. Lift 150 may be disposed adjacent to base 120, below base 120, level with base 120 or above base 120. In one embodiment, arm 152 of lift 150 may be positioned to apply force in an upward angle with respect to base 120 or a floor of a body of water, and arm 152 may be configured to apply force at an upward angle to interface with scissor hinge 160.

In one embodiment, it may be desired to position arm 152 at an upward angle instead of perpendicular to a surface of the body of water because in shallow water there may not be enough space to vertically position a lift 150 below bunk beams 110 while allowing bunk beams 110 to be positioned at a downward angle. Additionally, one skilled in the art will appreciate that instead of instead of using a lift 150 to raise and lower bunk beams 110, a system of cables, levers, pulleys and/or chains may be configured to interface with bunk beams at substantially the same position as pivot 162 to raise and lower bunk beams 110.

Scissor hinge 160 may be configured to couple with bunk beams 110, lift 150, and base 120 to extend and contract to raise and lower bunk beams 110. One skilled in the art will appreciate that scissor hinge 160 may be any type of hinge configured to rotate and/or pivot and couple various elements of vehicle lifting system 100. For example, scissor hinge 160 may be a scissor hinge, barrel hinge, pivoting hinge, etc. Scissor hinge 160 may be configured to allow for an angle or rotation between elements of vehicle lifting system 100.

Scissor hinge 160 may be coupled to bunk beams 110, lift 150, and base 120 at hinged, pivots 162, 164, and 166, respectively. One skilled in the art will appreciate that hollow, cylindrical shape cylinders may be positioned on bunk beams 110 and base 120 and coupled with pivots 162 and 166, respectively, by inserted pivots 162 and 166 into the cylinders. Scissor hinge 160 may be coupled to bunk beams 110 to reduce, limit and/or remove spreading issues caused by a watercraft vehicle applying outward force to the bunk beams 110.

In one embodiment, pivot 162 may be configured to couple scissor hinge 160 and bunk beams 110. Pivot 162 may be disposed at a position proximate to first end 190 of bunk beams 120. In one embodiment, pivot 162 may be positioned at any desired lifting point of bunk beams 110, for example 4' from a transom. Pivot 162 may be disposed adjacent to bunk beams 110 and on a lower surface of bunk beams 110. However, one skilled in the art will appreciate in other embodiments; pivot 162 may be positioned above, below or on a plane parallel with bunk beams 110.

Pivot 164 may be configured to couple scissor hinge 160 and arm 152 of lift 150. As arm 152 extends and contracts pivot point 164 may be configured to receive force from arm 152 and correspondingly extend and/or contract scissor hinge 160. In one embodiment, if arm 152 of lift 150 is contracted, second pivot 164 may be positioned closer to the lift 150 than when the arm 152 of lift 150 is extended.

Pivot 166 may be configured to couple scissor hinge 160 and base 120. In one embodiment, pivot 166 may be a fixed pivot disposed adjacent to base 120. One skilled in the art will appreciate, that pivot 166 may be positioned below, above, or a plane level with base 120. In one embodiment, pivots 162 and 166 may be configured to be vertically aligned if scissor hinge 160 is in an extended and/or a collapsed position.

In one embodiment, if arm 152 of lift 150 is contracted, pivot 162 may be configured to move in a downward direction and be closer to and/or adjacent to pivot 166. Additionally, if scissor hinge 160 is contracted bunk beams 110 may be positioned in a downward angle and a watercraft may drive onto the bunk beams 110. Subsequently, arm 152 of the lift 150 may be extended, applying force to pivot 164 to extend scissor hinge 160, raise bunk beams 110, and bunk beams 110 may support the watercraft at a plane level to the water level.

Furthermore, coupled to a first end of base 121 may be legs 182. On an upper surface of legs 182 may be disposed a pad 184 that is configured to extend across and/or past an upper surface of legs 182. In one embodiment, if scissor hinge 160 is in an extended position, scissor hinge 160 may be positioned adjacent to or interface with pad 184. Scissor hinge 160 may also apply force to pad 184 to relieve tension or force caused by bunk beams 110 supporting a watercraft vehicle. In one embodiment, if arm 152 of lift 150 is extended, the first, second, and third pivot points 162, 164, and 166 may be substantially vertical and perpendicular to base 120 of the watercraft lifting system 100.

Figure 2:
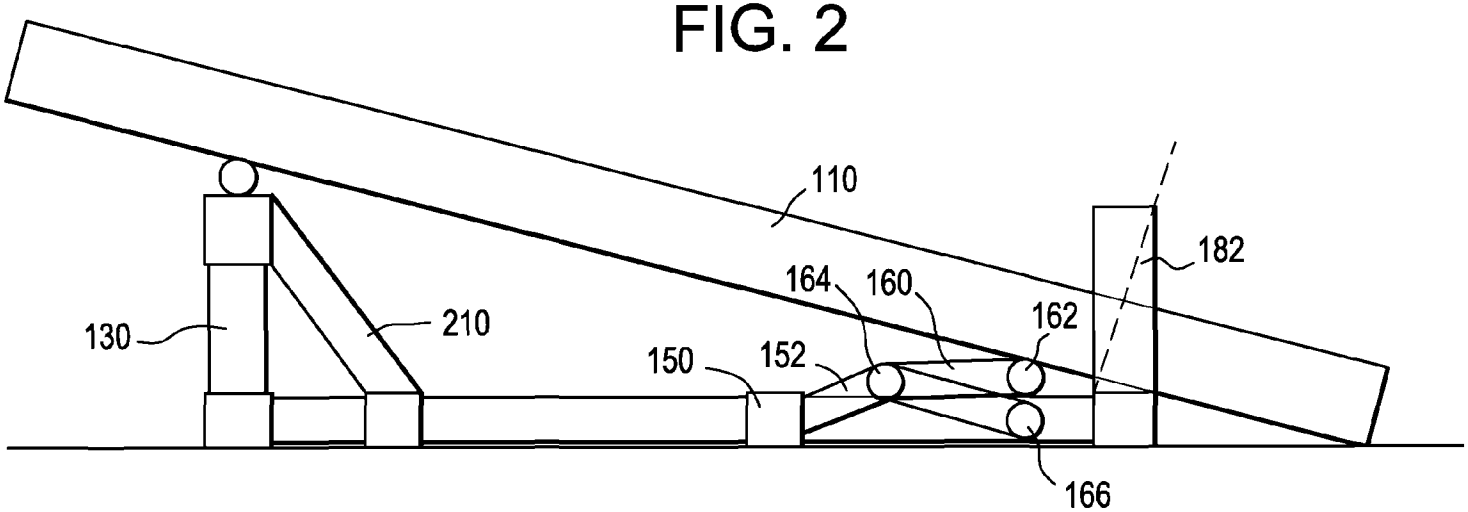
FIG. 2 depicts one embodiment of a watercraft vehicle lift if a scissor hinge is disposed in a contracted position.

FIG. 2 depicts one embodiment of a watercraft vehicle lift 100 if scissor hinge 160 is disposed in a contracted position.

If arm 152 of lift 150 is contracted, arm 152 may pull scissor hinge 160 via pivot 162 to be closer to lift 150. In response to arm 152 contracting, scissor hinge 160 may be configured to collapse, fold, and/or double over itself such that pivot points 162 and 166 are substantially vertically aligned and bunk beams 110 are positioned at a downward angle from fixed, pivoting hinge 140 towards the floor of the body of water.

In one embodiment, legs 130 may be coupled to base via an additional support 210. Additional support 210 may be configured to relieve tension from legs 130 applied from bunk beams 110 while supporting a watercraft vehicle.

In one embodiment, bunk beams 110 may be 20' and extend past base 120 on both sides, wherein in one embodiment base 120 may be 12'. In one embodiment, bunk beams 110 may extend 4' past base 120 on both sides. In one embodiment, legs 130 may be 20", and fixed, pivoting hinge 140 may be disposed adjacent to legs 130. One skilled in the art will appreciate that legs 130 may be configured to be raised and lowered such that an upper surface of legs 130 is substantially level with a water level of a body of water. Additionally, one skilled in the art will appreciate that the lengths of bunk beams 110 and base 120 may be adjusted to any desired length to support water craft vehicles of varying shape and/or size.

Figure 3:
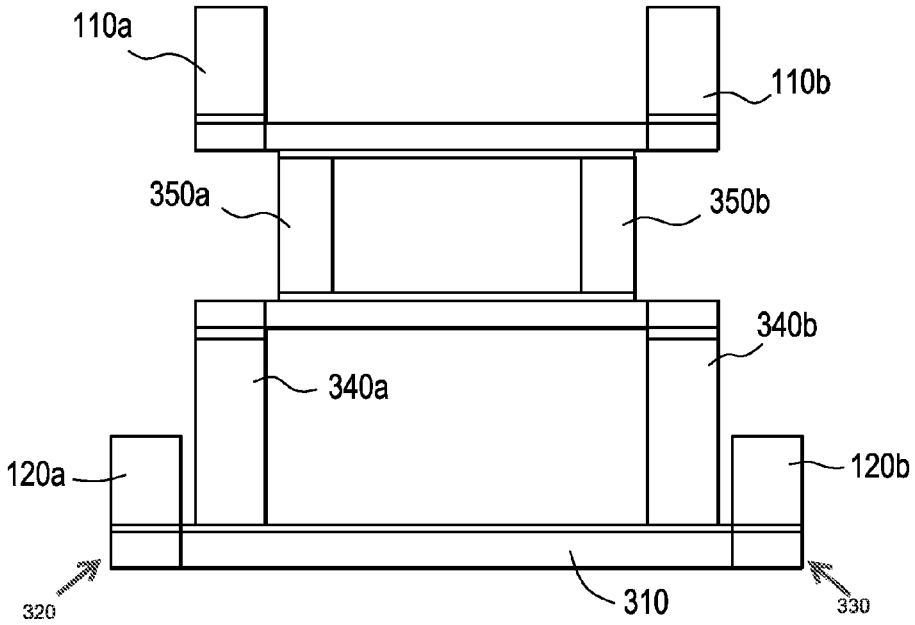
FIG. 3 depicts one embodiment of a front view of a watercraft vehicle lift.

FIG. 3 depicts one embodiment of a front view of a watercraft vehicle lift 100, if the arm of a lift (not shown) is extended and scissor hinge 160 is in an extended position.

In one embodiment, the base of vehicle lift system 100 includes a support beam 310 configured to couple a first side 320 of base 120(*a*) to a second side 330 of base 120(*b*). Support beam 310 may be configured to be positioned perpendicularly to base 120, and additional support beams (not shown) may be disposed between the front of base 120 and the back of base 120.

As depicted in FIG. 3, bunk beams 110 may be positioned above pivot 162 and form a concave shape configured to receive the hull of a watercraft vehicle. In one embodiment, the distance between an outer surface of a first bunk beam 110(*a*) and an outer surface of a second bunk beam 110(*b*) may be greater than 3' while a distance from an inner surface of first bunk beam 110(*a*) to an inner surface of second bunk beam 110(*b*) may be less than 3'. However, one skilled in the art will appreciate that the width from the outer and/or inner surfaces of bunk beams 110(*a*) and 100(*b*) may vary based on any desired length.

In one embodiment, as depicted in FIG. 3, pivot points 162, 164, and 166 may extend substantially across the width of support beam 310. As such, scissor hinge 160 may be configured to receive force applied by a watercraft vehicle that is supported by bunk beams 110.

Furthermore, scissor hinge 160 may include legs 340 positioned between pivot 166 coupled to support beam 310 and pivot 164, and legs 350 positioned between pivot 162 coupled to bunk beams 110 and pivot 164. In one embodiment, legs 340 may be positioned below and adjacent to an outer surface of legs 350, and legs 350 may be positioned above and adjacent to an inner surface of legs 340. When scissor hinge 160 is in a collapsed position, legs 340 and 350 may be configured to fold inward and be disposed parallel to each other.

Figure 4B:
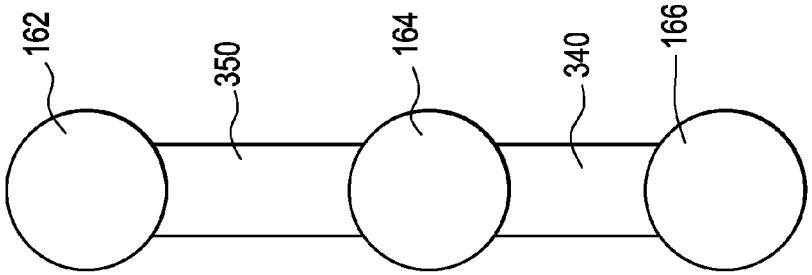
FIG. 4B depicts one embodiment of a side view of a scissor hinge.
Figure 4A:
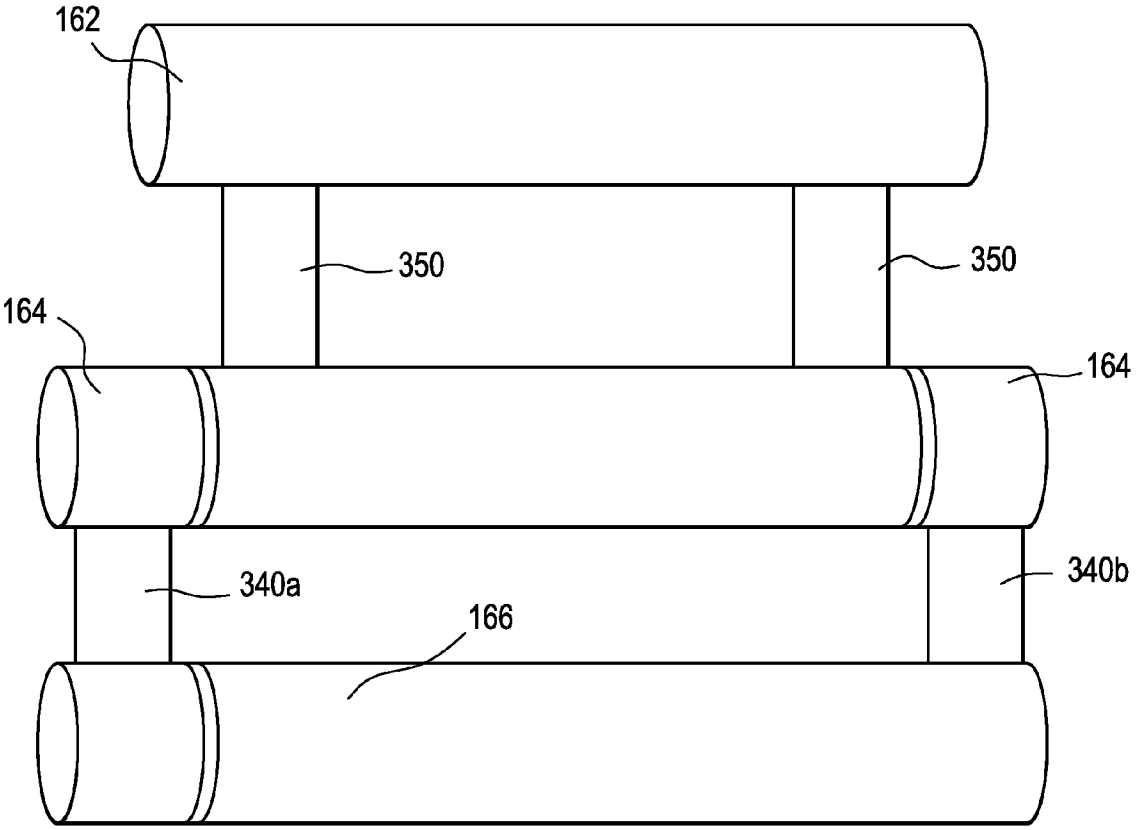
FIG. 4A depicts one embodiment of a front view of a scissor hinge.

FIG. 4A depicts one embodiment of a front view of scissor hinge 160, and FIG. 4B depicts one embodiment of a side view of scissor hinge 160. In one embodiment, the pivots 162, 164 and 166 may be substantially cylindrical and may be approximately 2" in radius. Furthermore, the length of legs 340 may be greater than the length of legs 350. In one embodiment, legs 340 may be 9¾" long and legs 350 may be 8¼" long.

In one embodiment, pivot 162 may extend past both legs 350 and be configured to be received by bunk beams (not shown). In one embodiment, a distance between inner surface of leg 350(*a*) to leg 350(*b*) may be 12¾" long, and a length of pivot 162 may be 22" long.

In one embodiment, pivot 164 may be configured to extend past legs 350 and the outer surfaces of pivots 162, in one embodiment, pivot 164 may be 27¾" in length, with 4" of pivot 164 being disposed on an outer surface of leg 350(*a*) and 350(*b*).

Pivot 166 may have a longer length than pivots 162 and 164. In one embodiment, pivot 166 may have a length of 31⅞". In one embodiment, legs 340(*a*) and 340(*b*) may be positioned adjacent to the outer surfaces of pivot 166. In one embodiment, a distance between an inner surface of leg 340(*a*) and leg 340(*b*) may be 20¾".

Figure 5:
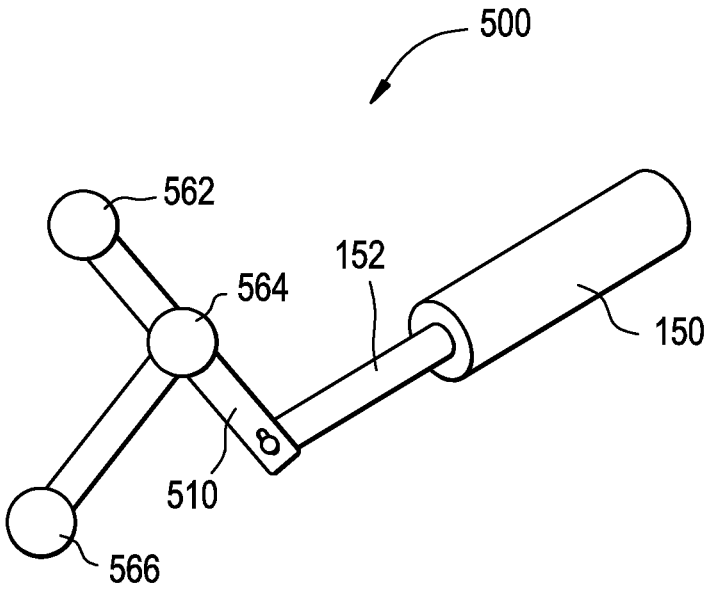
FIG. 5 depicts one embodiment of a scissor hinge with a projection to receive force.

FIG. 5 depicts one embodiment of scissor hinge 500. Elements depicted in FIG. 5 may be substantially the same as those depicted in FIG. 1 and for the sake of brevity an additional description is omitted. Scissor hinge 500 may include three pivot points 562, 564, and 566. As depicted in FIG. 5, a projection 510 may be coupled to pivot 564 and arm 152 of lift 150.

In FIG. 5 instead of a pivot affixed to scissor hinge 500 receiving force from arm 152, projection 510 may be configured to receive force applied by arm 152.

As arm 152 extends, projection 510 may apply force to pivot 564 to extend scissor hinge 500. Additionally, as arm 152 contracts, projection 510 may pull pivot 564 to force scissor hinge 500 to fold and/or contract.

In one embodiment, lift 150 may be configured to extend and contract arm 152 in a downward angle from an axis substantially parallel to pivot point 564 and/or towards a floor of the body of water. As such, when arm 152 applies force on projection 510, pivot 564 may move on an axis that is parallel to a floor of the body of water, and pivot point 562 may move on an axis that is perpendicular to a floor of the body of water.

In the foregoing specification, embodiments have been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function).

Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate.

As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment," "an embodiment," or "a specific embodiment" or similar terminology means that a particular feature, structure, or characteristic described in connection with the embodiment is included in at least one embodiment and may not necessarily be present in all embodiments. Thus, respective appearances of the phrases "in one embodiment," "in an embodiment," or "in a specific embodiment" or similar terminology in various places throughout this specification are not necessarily referring to the same embodiment.

Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

Furthermore, the term "or" as used herein is generally intended to mean "and/or" unless otherwise indicated. As used herein, a term preceded by "a" or "an" (and "the" when antecedent basis is "a" or "an") includes both singular and plural of such term (i.e., that the reference "a" or "an" clearly indicates only the singular or only the plural). Also, as used in the description herein, the meaning of "in" includes "in" and "on" unless the context clearly dictates otherwise.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A watercraft vehicle lift, comprising:

a pivoting hinge configured to rotate around a fixed axis;

a hydraulic lift configured to extend and contract an arm to apply force at an acute angle, wherein the acute angle is based on a floor of a body of water;

a scissor hinge with a plurality of pivoting points configured to extend and contract, a first of the plurality of pivoting points being positioned below a water level, and the first of the plurality of pivoting points being configured to receive the applied force from the arm of the hydraulic lift at the acute angle below the water level, wherein responsive to the arm being contracted the arm decreases in length and directly pulls the first of the plurality of pivoting points, wherein a second one of the plurality of pivoting points is coupled to a base of the watercraft vehicle lift, wherein the base extends from a point below the pivoting hinge to the second one of the plurality of pivoting points;

a bunk beam coupled with the scissor hinge at a first portion via a third of the plurality of pivoting points and coupled with the pivoting hinge at a second portion, wherein responsive to the scissor hinge receiving the force from the arm of the hydraulic lift at the acute angle a first side of the bunk beam is configured to be raised or lowered, and responsive to the arm being contracted and decreasing in length directly pulling the first of the plurality of pivoting points the bunk beam is configured to be lowered to be positioned in a downward angle, wherein when the arm of the hydraulic lift is contracted then the first of the plurality of pivoting points is positioned between the hydraulic lift and the second and third of the plurality of pivoting points.

2. The watercraft vehicle lift of claim 1, wherein the second of the plurality of pivoting points being vertically aligned with the third of the plurality of pivoting points when the arm of the hydraulic lift is extended.

3. The watercraft vehicle lift of claim 1, wherein if the arm of the hyraludic lift is contracted, the scissor hinge is configured to fold over itself.

4. The watercraft vehicle lift of claim 1, wherein if the arm of the hydraulic lift is extended the plurality of pivoting points are vertically aligned, and the bunk beam is configured to be parallel to a water level of a body of water.

5. The watercraft vehicle lift of claim 4, wherein when the arm of the hydraulic lift is extended the scissor hinge applies pressure to the leg.

6. The watercraft vehicle lift of claim 1, wherein the bunk beam extends past the scissor hinge and the pivoting hinge.

7. The watercraft vehicle lift of claim 1, wherein the pivoting hinge is configured to be raised and lowered.

8. The watercraft vehicle lift of claim 1, further comprising:

a second bunk beam, wherein the scissor hinge is configured to extend from the bunk beam to the second bunk beam at a third pivoting point.

9. The watercraft vehicle lift of claim 1, wherein the bunk beam is configured to allow a watercraft to drive onto the bunk beam when the bunk beam is in a downward angle, and the bunk beam is configured to raise to support the watercraft and be horizontally aligned with the water level.

10. A method for a watercraft vehicle lift comprising:

rotating a hinge around a fixed axis;

extending an arm of a hydraulic lift to apply force at an acute angle, wherein the acute angle is based on a floor of a body of water;

receiving the force from the arm of the lift at a first of a plurality of pivoting points of a scissor hinge, wherein the scissor hinge includes the plurality of pivoting points and the scissor hinge is positioned below a water level;

extending or contracting the scissor hinge in response to the first of the plurality of pivoting points directly receiving the force from the arm of the lift, wherein the first of the plurality of pivoting points being configured to receive the applied force from the arm of the hydraulic lift at the acute angle below the water level;

extending the arm of the lift to push the first of the plurality of pivoting points; and rotating a bunk beam from a downward angle to a level plane in response to the force being applied from the arm of the hydraulic lift at the acute angle directly to the first of the plurality of pivoting points, the bunk beam being configured to be coupled with the hinge around the fixed axis and a third of the plurality of pivoting points of the scissor hinge, wherein a second one of the plurality of pivoting points is coupled to a base of the watercraft vehicle lift, the base extending from a point below the rotating hinge to the second one of the plurality of pivoting points, wherein when the arm of the hydraulic lift is contracted then the first of the plurality of pivoting points is positioned between the hydraulic lift and the second and third of the plurality of pivoting points.

11. The method of claim 10, wherein the third of the plurality of pivoting points is configured to be coupled with the bunk beam.

12. The method of claim 10, further comprising:

contracting the arm of the hydraulic lift;

contracting the scissor hinge; and moving the bunk beam from the level plane in the downward angle in response to the contracting the arm of the hydraulic lift at the acute angle.

13. The method of claim 12, wherein the contracting includes folding the scissor hinge over itself.

14. The method of claim 10, further comprising:

applying force from the scissor hinge to a leg of a base of the watercraft vehicle lift.

15. The method of claim 10, further comprising:

vertically aligning the plurality of pivoting points of the scissor hinge.

16. A drive-on watercraft vehicle lift, comprising:

a pivoting hinge configured to rotate around a fixed axis;

a hydraulic lift configured to extend and contract an arm to apply force at an acute angle, wherein the acute angle is based on a floor of a body of water;

a bunk beam coupled to the pivoting hinge and configured to be raised and lowered by the lift;

a base positioned on the floor of the body of water;

a scissor hinge, positioned below a water level, including a plurality of pivoting points configured to receive force from the arm of the hydraulic lift at an acute angle, a first of the plurality of pivoting points being coupled to the bunk beam, a second of the plurality of pivoting points being coupled to the arm of the hydraulic lift, and a third of the plurality of pivoting points being coupled to the base of the watercraft vehicle lift, the base of the watercraft lift extending from a point below the pivoting hinge to the third one of the plurality of pivoting points, wherein the second of the plurality of pivoting points is configured to directly receive force from the arm of the hydraulic lift, and responsive to the second of the plurality of pivoting points receiving the force from the arm of the hydraulic lift at the acute angle a first end of the bunk beam is configured to be raised, wherein when the arm of the hydraulic lift is contracted the scissor hinge is folded over itself and the bunk beam is positioned in a downward angle, and vertically aligning the plurality of pivoting points when the arm of the lift is extended, and when the arm of the hydraulic lift is extended the bunk beam is positioned parallel to a water level, wherein when the arm of the hydraulic lift is contracted then the second of the plurality of pivoting points is positioned between the hydraulic lift and the first and third of the plurality of pivoting points.

* * * * *